US006058734A

United States Patent [19]

Lee

[11] Patent Number: 6,058,734

[45] Date of Patent: May 9, 2000

[54] REFRIGERATOR PROVIDED WITH COOLED AIR BYPASS PASSAGES

[75] Inventor: Jung Owan Lee, Seoul, Rep. of Korea

[73] Assignee: Daewoo Electronics Co., Ltd., Rep. of Korea

[21] Appl. No.: 09/210,606

[22] Filed: Dec. 15, 1998

[51] Int. Cl.[7] ..... F25D 17/04

[52] U.S. Cl. ..... 62/408; 62/407; 62/283; 62/441; 62/447

[58] Field of Search ..... 62/407, 283, 441, 62/447, 408

[56] References Cited

U.S. PATENT DOCUMENTS

| | | | |
|---|---|---|---|
| 4,759,195 | 7/1988 | Biancardi | 62/283 |
| 5,009,084 | 4/1991 | Tanaka et al. | 62/441 |
| 5,497,634 | 3/1996 | Kojima et al. | 62/441 |
| 5,694,788 | 12/1997 | Shin | 62/407 |
| 5,706,673 | 1/1998 | Shin | 62/455 |
| 5,826,441 | 10/1998 | Oh . | |
| 5,896,748 | 4/1999 | Park | 62/179 |
| 5,899,090 | 5/1999 | Lyu | 62/408 |
| 5,901,569 | 5/1999 | Sin | 62/407 |
| 5,960,641 | 10/1999 | Kim et al. | 62/407 |

FOREIGN PATENT DOCUMENTS

| | | |
|---|---|---|
| 0592004 | 4/1994 | European Pat. Off. . |
| 9533963 | 12/1995 | WIPO . |

*Primary Examiner*—Henry Bennett
*Assistant Examiner*—Mark Shulman
*Attorney, Agent, or Firm*—Pennie & Edmonds LLP

[57] ABSTRACT

A refrigerator has a freezer compartment, a refrigerating compartment, and an evaporator. The refrigerator further has a first bypass passage, a second bypass passage and a cooled air inducing pipe.

The first bypass passage allows the cooled air from the refrigerating compartment to flow directly to a fan of the refrigerating compartment, thereby allowing the cooled air to bypass the evaporator.

The second bypass passage allows the cooled air from the freezer compartment to flow directly to a fan of the freezer compartment, thereby allowing the cooled air to bypass the evaporator.

The cooled air inducing pipe mounted in front of the fan changes the direction of the cooled air and force the cooled air to the refrigerating compartment.

3 Claims, 5 Drawing Sheets

REFRIGERATOR PROVIDED WITH COOLED AIR BYPASS PASSAGES

FIELD OF THE INVENTION

The present invention relates to a refrigerator; and, more particularly, to a refrigerator with air bypass passages which allow cooled air to circulate therein, even when some portions of an evaporator are covered with frost.

BACKGROUND OF THE INVENTION

Generally a refrigerator is equipped with an evaporator for cooling air to be circulated therein. After a prolonged use, frost is bound to be formed on the evaporator.

If too much frost gets formed on the evaporator, the cooling performance thereof gets deteriorated and the circulation of the cooled air also gets hindered within the refrigerator by the frost blocking the air passages.

To defrost the frost from the evaporator, the refrigerator is conventionally provided with a defrosting mode. Whether to operate or not in the defrosting mode is determined by a power dissipated for driving a compressor and a variation of the temperature during the driving of the compressor.

However, in the conventional refrigerator, too much frost is usually formed on the evaporator before the refrigerator begins automatically to operate in the defrosting mode, first resulting in blocking of the cooled air passages, resulting in the performance of the refrigerator being deteriorated.

SUMMARY OF THE INVENTION

It is, therefore, a primary object of the present invention to provide a refrigerator with air bypass passages which allow cooled air to circulate therein, even when some portions of an evaporator are covered with frost.

The above and other objects of the present invention are accomplished by providing a refrigerator having a freezer compartment with a fan, a refrigerating compartment with a fan, and an evaporator, said refrigerator comprising; a first bypass passage for flowing cooled air from the refrigerating compartment directly to the fan of the refrigerating compartment, thereby allowing the cooled air to bypass the evaporator; and a second bypass passage for flowing the cooled air from the freezer compartment directly to the fan of the freezer compartment, thereby allowing the cooled air to bypass the evaporator.

BRIEF DESCRIPTION OF THE DRAWINGS

The above and other objects and features of the instant invention will become apparent from the following description of preferred embodiment taken in conjunction with the accompanying drawings, in which.

DETAILED DESCRIPTION OF THE PREFERRED EMBODIMENT

Figure 1:
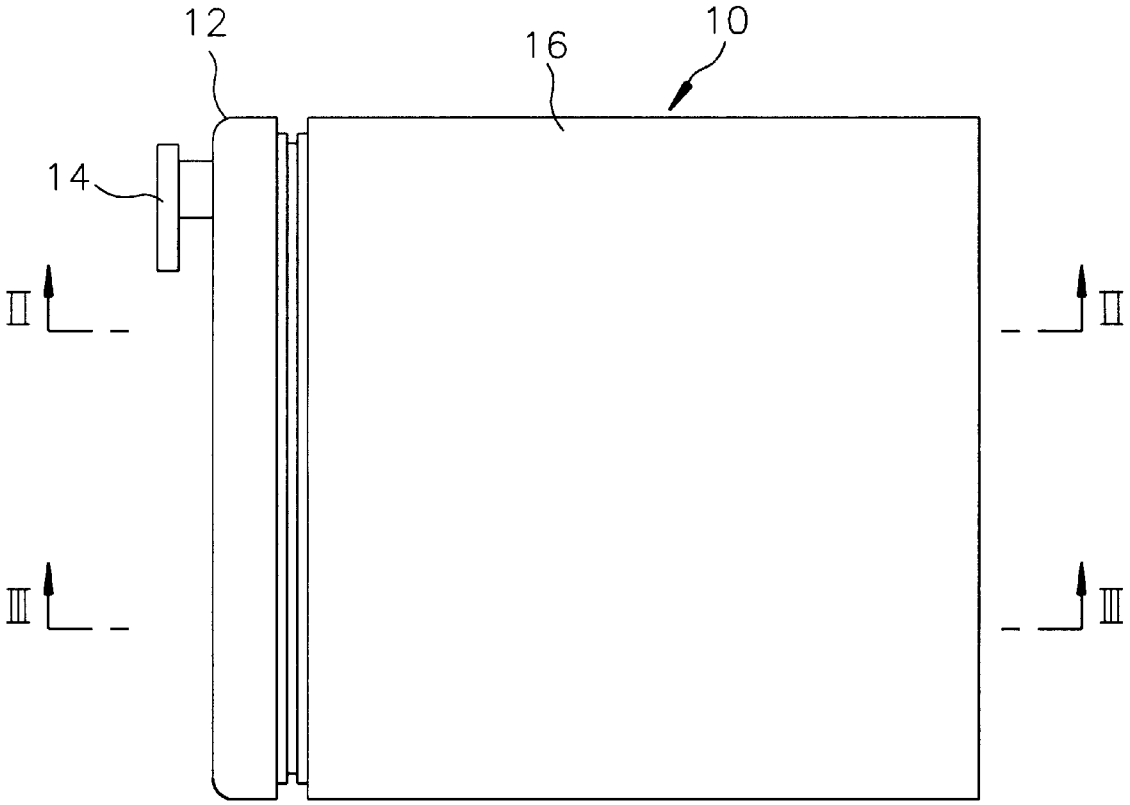
FIG. 1 illustrates a schematic top view of a preferred embodiment of the present invention.
Figure 2:
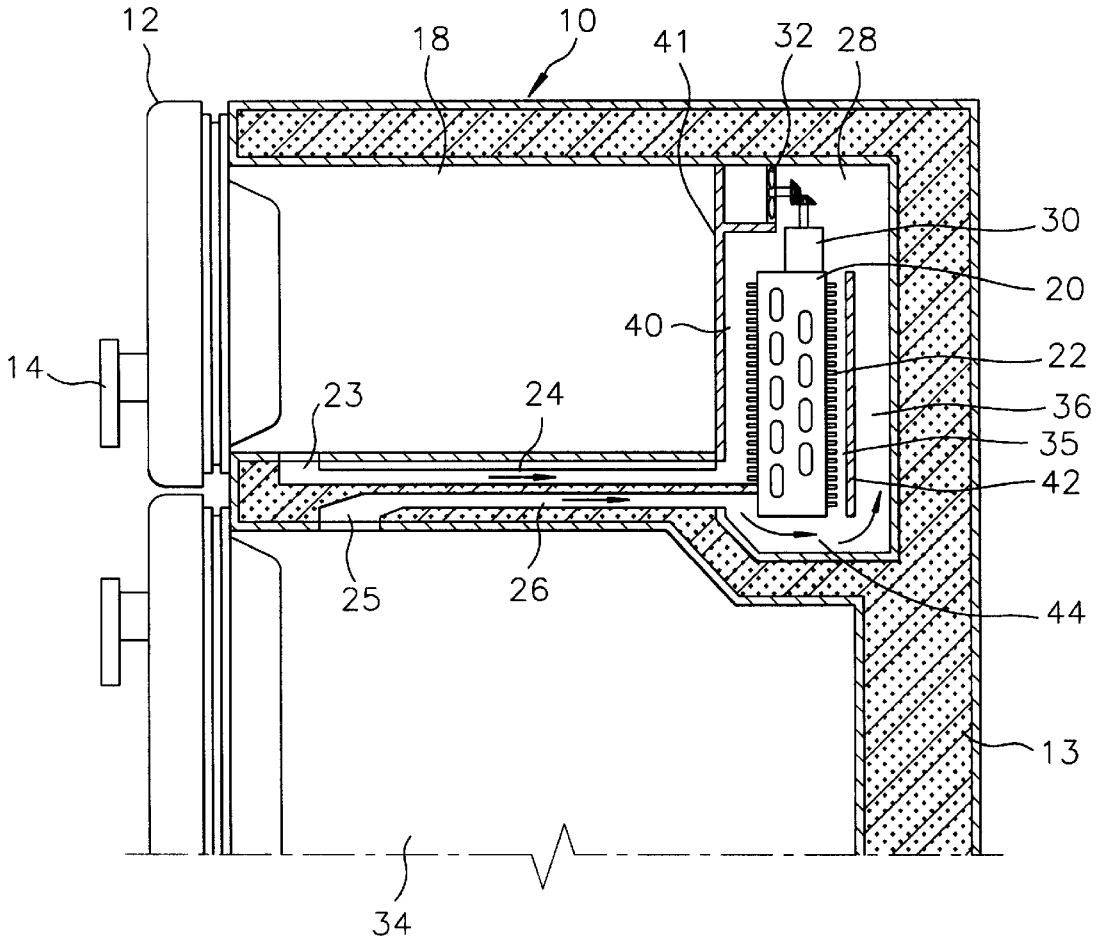
FIGS. 2 and 3 are sectional views of FIG. 1 along lines II—II and III—III, respectively.

A refrigerator provided with a cooled air bypass passages according to the preferred embodiment of the present invention is disclosed in FIGS. 1 to 5. As shown in FIGS. 1 and 2, the refrigerator 10 has a freezer compartment 18 on an upper portion thereof and a refrigerating compartment 34 on a lower portion thereof. The refrigerator 10 further has a door 12 having a grip 14 and a separating wall 41 at back of the freezer compartment 18 to thereby form a freezing space. The refrigerator 10 further has a rear wall 13 filled with urethane foams.

Figure 4:
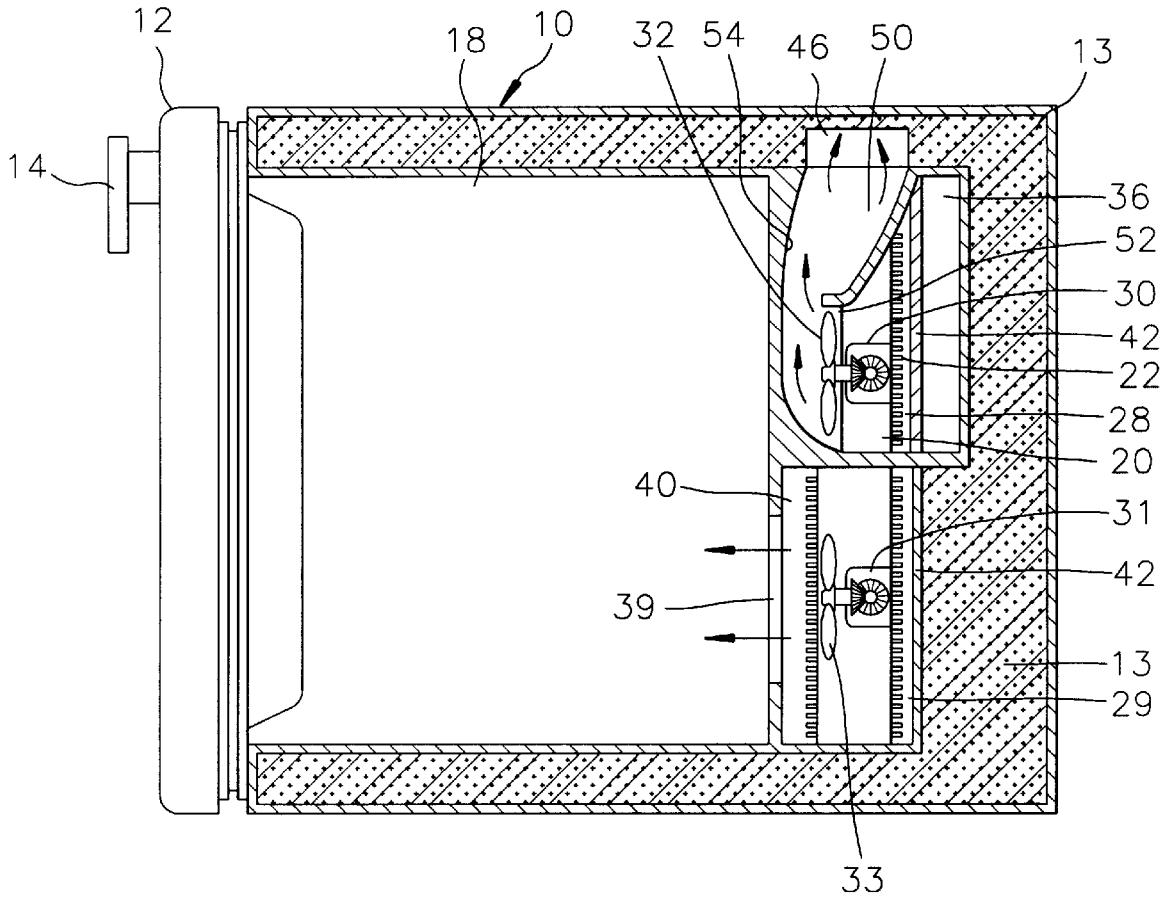
FIG. 4 depicts a sectional plan view of the preferred embodiment of the present invention.

As shown in FIGS. 2 and 4, an evaporator 20 is mounted in the rear portion of the freezer compartment 18. The evaporator 20 has a plurality of fins 22 thereon. On top of the evaporator 20 is formed a retaining space 28 for retaining a fan 32 for the refrigerating compartment 34. The fan 32 is mounted in the retaining space 28 and driven by a driving motor 30. The fan 32 blows cooled air in the retaining space 28 into the refrigerating compartment 34 through a duct 46.

The cooled air sucked into the refrigerating compartment 34 is circulated therein. The cooled air circulated in the refrigerating compartment 34 returns to the retaining space 28 after passing through an outlet 25, a first returning area 26 and a horizontal area of a second returning area 44, then ascends to the rear portion of the evaporator 20.

The cooled air passes through two passages, as it ascends to the rear portion of the evaporator 20. One of the passages is an evaporator contacting passage 35 formed between a perpendicular panel 42 and the evaporator 20 to allow the cooled air to ascend to the fins 22 of the evaporator 20. The other passage is a first bypass passage 36 formed by the perpendicular panel 42 and a rear wall 13 to allow the cooled air to be sucked directly into the retaining space 28. The cooled air sucked into the retaining space 28 enters the duct 46 by the action of the fan 32 through an inlet 52 of a cooled air inducing pipe 50. An inner wall 54 of the cooled air inducing pipe 50 formed on backside of the separating wall 41 serves to change the direction of the flow of the cooled air. The presence of the first bypass passage 36 allows the cooled air to circulate even if the evaporator contacting passage 35 gets blocked with the frost formed therein.

Figure 3:
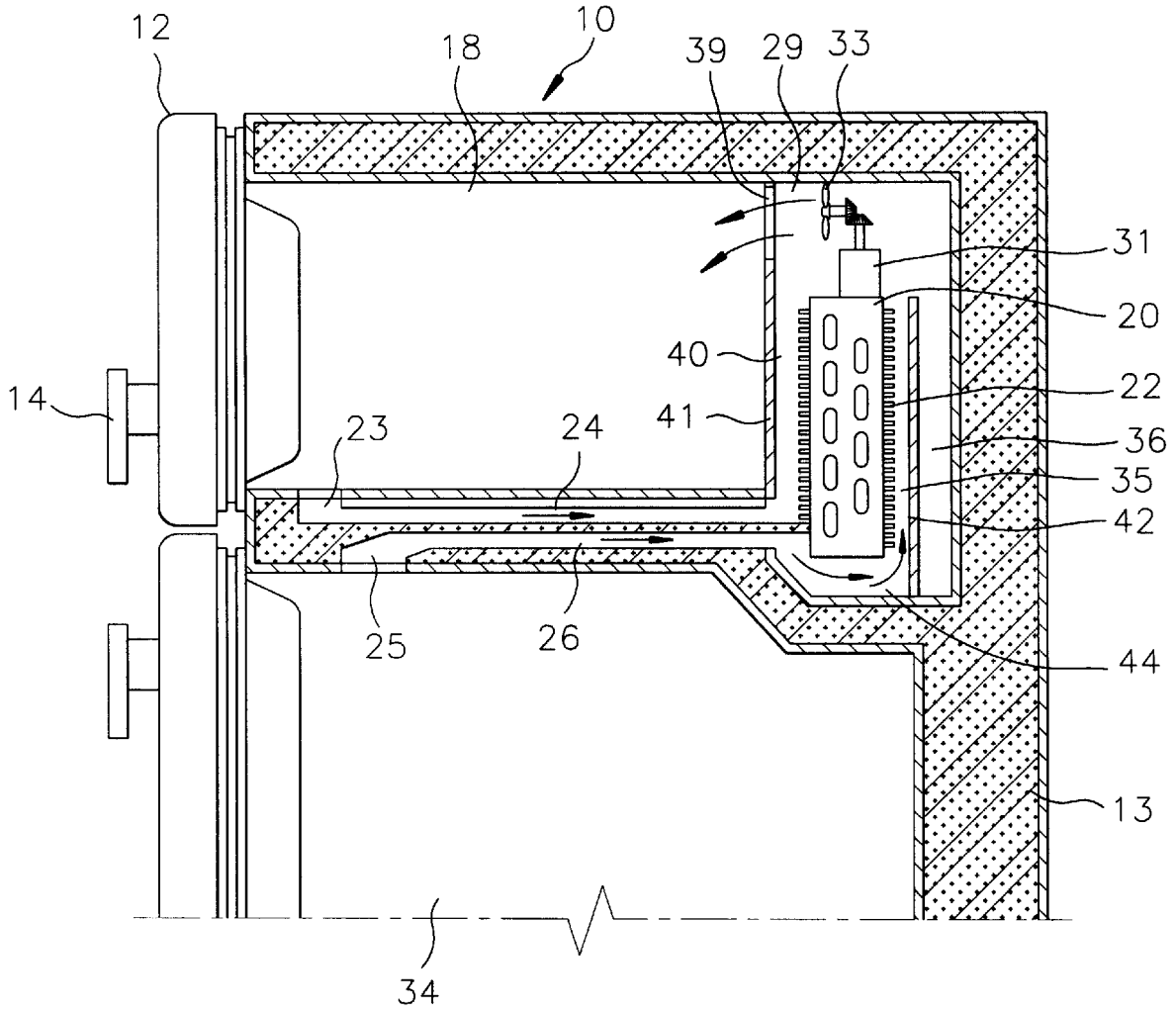

As shown in FIGS. 3 and 4, a retaining space 29 for retaining the fan 33 for the freezer compartment 18 is formed on top of the evaporator 20. The fan 33 is mounted in the retaining space 29 and driven by a driving motor 31. The fan 33 blows the cooled air in the retaining space 29 into the freezer compartment 18 through an inlet 39 for the cooled air.

The cooled air sucked into the freezer compartment 18 is circulated therein. The cooled air circulated in the freezer compartment 18 returns to the retaining space 29 after passing through the outlet 23, a horizontal returning area 24 and a second bypass passage 40, then ascends to the front portion of the evaporator 20.

The second bypass passage 40 formed by the evaporator 20 and the separating wall 41 makes a large spare space to allow some of the cooled air to ascend therethrough to the retaining space 29 and contact the fins 22, with the rest bypassing the fins 22. The presence of the second bypass passage 40 allows the cooled air to circulate even if a large amount of frost is formed between the evaporator 20 and the separating wall 41.

Figure 5:
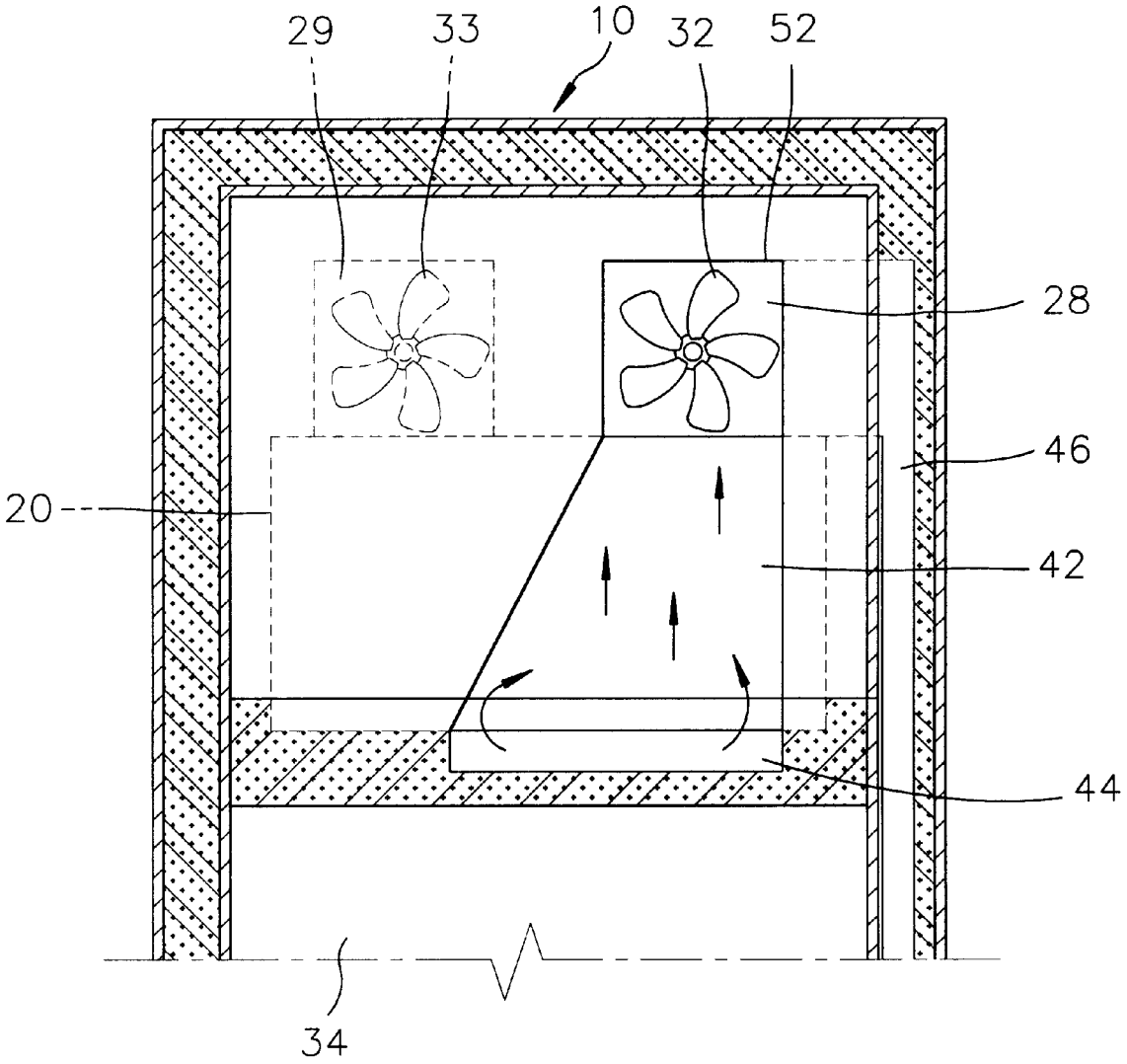
FIG. 5 describes a rear view showing a first bypass passage according to the preferred embodiment of the present invention.

As shown in FIG. 5, the first bypass passage 36 for bypassing the cooled air to a fan 32 for the refrigerating compartment 34 has a first side wall being tilted when viewed from the rear of the refrigerator 10 and a nearly perpendicular second side wall forming a passage for connecting a second returning area 44, the retaining space 28 and the inlet 52 of the cooled air inducing pipe 50. Further, it is preferable that the length of the inlet portion of the first bypass passage 36 connected to the second returning area 44 is about ⅔ of the lateral length of the evaporator 20.

According to the preferred embodiment of the present invention, the bypass passages allow the cooled air to circulate inside the refrigerator until the defrosting mode is initiated to remove the frost filling the cooled air circulation passage and around the evaporator.

Although the invention has been shown and described with respect to the preferred embodiment, it will be understood by those skilled in the art that various changes and modifications may be made without departing from the spirit and scope of the invention as defined in the following claims.

What is claimed is:

1. A refrigerator having a freezer compartment with a fan, a refrigerating compartment with a fan, and an evaporator, said refrigerator comprising;

a first bypass passage for flowing cooled air from the refrigerating compartment directly to the fan of the refrigerating compartment, thereby allowing the cooled air to bypass the evaporator; and a second bypass passage for flowing the cooled air from the freezer compartment directly to the fan of the freezer compartment, thereby allowing the cooled air to bypass the evaporator.

2. The refrigerator according to claim 1, wherein the length of an inlet portion of the first bypass passage is about ⅔ of the length of the evaporator.

3. The refrigerator according to claim 1, wherein the cooled air from the fan of the refrigerating compartment flows through a cooled air inducing pipe mounted in front of the fan, changing its direction of flow to the refrigerating compartment.

* * * * *